US007717633B2

(12) United States Patent
Sakano

(10) Patent No.: US 7,717,633 B2
(45) Date of Patent: May 18, 2010

(54) SHEET BUNDLE PRINTING SYSTEM AND SHEET BUNDLE PRINTER

(75) Inventor: Hideki Sakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 513 days.

(21) Appl. No.: 11/733,647

(22) Filed: Apr. 10, 2007

(65) Prior Publication Data

US 2008/0022873 A1 Jan. 31, 2008

(30) Foreign Application Priority Data

Jul. 28, 2006 (JP) ..... 2006-207145

(51) Int. Cl.
*B41J 33/54* (2006.01)

(52) U.S. Cl. ..... 400/649; 400/663

(58) Field of Classification Search ..... 400/660.2, 400/663, 664

See application file for complete search history.

(56) References Cited

U.S. PATENT DOCUMENTS 4,746,234 A * 5/1988 Harry ..... 400/120.01
2004/0061768 A1* 4/2004 Nishimura ..... 347/218

FOREIGN PATENT DOCUMENTS

| | | | |
|---|---|---|---|
| JP | 01262169 A | * | 10/1989 |
| JP | 04101852 A | * | 4/1992 |
| JP | 04353469 A | * | 12/1992 |
| JP | 2003-011436 | | 1/2003 |
| JP | 2003-011437 | | 1/2003 |
| JP | 2003-081455 | | 3/2003 |
| JP | 2003-081457 | | 3/2003 |
| JP | 2003-212367 | | 7/2003 |
| JP | 2006-175878 | | 7/2006 |

* cited by examiner

*Primary Examiner*—Daniel J Colilla
(74) *Attorney, Agent, or Firm*—Hogan & Hartson LLP

(57) ABSTRACT

In a sheet bundle printing system, a sheet is fed by peeling an uppermost sheet from a sheet bundle. A printing device has a printing head and a platen roller for printing on the sheet. An ink ribbon is fed through space between the printing head and the platen roller in parallel with the sheet at the time of printing thereon. The platen roller is moved back and forth relative to the printing head between a printing position in which the platen roller is urged into contact with the printing head and a contact-free position in which the platen roller is out of contact with the printing head. Ink-ribbon feeding is suspended in a manner interlocked with the relative movement of the printing head and the platen roller between the printing position and the contact-free position.

8 Claims, 8 Drawing Sheets

80
78
81
R
51
74
85
26
86
71
50
52
39
75
H1
H
37
35
7

SHEET BUNDLE PRINTING SYSTEM AND SHEET BUNDLE PRINTER

The entire disclosure of Japanese Patent Application No. 2006-207145, filed Jul. 28, 2006, is expressly incorporated by reference herein.

BACKGROUND

1. Technical Field

The present invention relates to a sheet bundle printing system for printing on a piece of sheet (hereinafter simply referred to as "a sheet") to be peeled off out of a sheet bundle such as a sticky note bundle (i.e., a bundle of sticky notes temporarily held together by partially and removably adhering them together for use by peeling off one by one) and the like, and also relates to a sheet bundle printer.

2. Related Art

As a sticky note printer (sheet bundle printer) to which this kind of sheet bundle printing system is applied, there is known one in which the uppermost sticky note is turned over or flipped from the bundle of sticky notes set in position and in which the flipped sticky note is then held between a thermal head and a platen roller together with an ink ribbon for performing printing thereon. JP-A-2003-212367 is an example of related art.

In using a sticky note, there is a case where a sticky note is used as it is without printing thereon so that the user manually writes a memo thereon or adheres it on a particular page of a magazine and the like for the purpose of marking the page. The sticky note printer will thus have to eject the sticky note intact without printing thereon.

However, in case the sticky note is fed without printing thereon (i.e., empty feeding), the above-described conventional sticky note printer is so arranged that the sticky note and the ink ribbon are fed without driving the thermal head. Since a sticky note free from printing thereon is ejected in this manner, there is a problem in that the ink ribbon is wasted even in case of empty feeding.

SUMMARY

It is an advantage of the invention to provide a sheet bundle printing system and a sheet bundle printer which are capable of empty-feeding a sheet toward a sheet ejecting slot without wasting an ink ribbon.

A sheet bundle printing system according to a first aspect of the invention comprises: a sheet transfer device for transferring a sheet toward a sheet ejecting slot by peeling an uppermost sheet out of a sheet bundle made up of a multiplicity of sheets releasably adhered together at one end respectively; a printing device having a printing head and a platen roller, the printing device being for printing on a sheet fed by the sheet transfer device through space between the printing head and the platen roller; a ribbon feed device for feeding an ink ribbon through space between the printing head and the platen roller, the feeding being made in parallel with the sheet at the time of printing thereon; a back-and-forth moving device for manually moving the platen roller relative to the printing head between a printing position in which the platen roller is urged into contact with the printing head and a contact-free position in which the platen roller is out of contact with the printing head; and a ribbon-feed suspension device for suspending the ink-ribbon feeding by the ribbon feed device in a manner interlocked with a relative movement, by the back-and-forth moving device, of the printing head and the platen roller between the printing position and the contact-free position.

A sheet bundle printing system according to a second aspect of the invention comprises: a sheet transfer device for transferring a sheet toward a sheet ejecting slot by peeling an uppermost sheet out of a sheet bundle made up of a multiplicity of sheets releasably adhered together at one end respectively; a printing device having a printing head and a platen roller, the printing device being for printing on a sheet fed by the sheet transfer device through space between the printing head and the platen roller; a ribbon feed device for feeding an ink ribbon through space between the printing head and the platen roller, the feeding being made in parallel with the sheet at the time of printing thereon; a back-and-forth moving device for moving the platen roller relative to the printing head between a printing position in which the platen roller is urged into contact with the printing head and a contact-free position in which the platen roller is out of contact with the printing head; and a ribbon-feed suspension device for suspending the ink-ribbon feeding by the ribbon feed device in a manner interlocked with a relative movement, by the back-and-forth moving device, of the printing head and the platen roller between the printing position and the contact-free position.

According to the above arrangements, when the platen roller is relatively moved to the print-free position of the printing head by the back-and-forth moving device, the feeding of the ink ribbon is suspended (stopped) by the ribbon-feed suspension device in a manner interlocked with the above-described relative movement (The term "back-and-forth moving device" represents, in a generic sense, that the device is capable of moving an object between predetermined two positions. The direction of movement shall therefore be understood not limiting to "back" and "forth"; it may instead be between, e.g., a "first" position and a "second" position). In this state, when the sheet transfer device transfers the sheet, the sheet passes through the space between the printing head and the platen roller. The sheet is thus fed toward the sheet ejecting slot, but the ink ribbon will not be fed. In addition, since the printing head and the platen roller become out of contact with (or away from) each other, the sheet and the ink ribbon will not be held therebetween. As a result, the ink ribbon will neither be fed together with the feeding of the sheet. It is thus possible to empty-feed the sheet. As a sheet bundle, there may be used a sticky note bundle, a memo pad, and the like.

It is preferable that the back-and-forth moving device comprise: a manual operation lever for moving the platen roller back and forth; and a back-and-forth moving link for moving the platen roller back and forth in a manner interlocked with operation of the manual operation lever.

According to this arrangement, by operating the manual operation lever, the platen roller can freely be moved between the printing position and the contact-free position.

It is preferable that the system further comprise a lock-and-unlock mechanism which maintains the platen roller in the contact-free position in a manner interlocked with the operation of the manual operation lever and which, in a manner interlocked with termination of transfer movement by the transfer device, releases the state of maintaining the platen roller at the contact-free position, thereby moving the platen roller to the printing position.

According to this arrangement, by operating the manual operation lever, the platen roller is locked to the contact-free position by means of the lock-and-unlock mechanism. Therefore, it is not necessary for the user to keep operating the manual operation lever during the transfer of the sticky note. On the other hand, once the sheet transfer by the sheet transfer device has been finished, the lock-and-unlock mechanism is unlocked with the termination of the transfer operation. As a result, the platen roller is moved to the printing position. It is thus neither necessary for the user to operate the manual operation lever to return the platen roller. In this manner, operability of the manual operation lever can be improved.

In the above-described second aspect of the sheet bundle printing system, it is preferable that the back-and-forth moving device comprise: a solenoid for moving the platen roller back and forth; and a back-and-forth moving link for moving the platen roller back and forth in a manner interlocked with driving of the solenoid.

According to this arrangement, by exciting or degaussing the solenoid, the platen roller can be moved to the printing position and the contact-free position.

It is preferable that the back-and-forth moving device comprise: an actuator for moving the platen roller back and forth; a plate cam rotated by driving of the actuator; and a back-and-forth moving link for moving the platen roller into the contact-free position by bringing the plate cam into contact therewith.

According to this arrangement, by rotating the plate cam by means of the actuator, the platen roller can be moved between the printing position and the contact-free position.

It is preferable that the system further comprise: a detecting device for detecting that the platen roller has moved to the contact-free position relative to the printing head; and a control device for controlling the sheet transfer device and the printing device, wherein the control device feeds the sheet to the sheet ejecting slot without printing thereon depending on the result of detection by the detecting device.

According to this arrangement, the empty feeding of the sheet can be started with the detection by the detecting device serving as a trigger. In addition, the feeding of the sheet will not be performed in a state in which the printing head is in contact with the platen roller due to a mechanical trouble.

It is preferable that the platen roller be made up of a driving roller and drive in a manner synchronized with the driving of the sheet transfer device.

According to this arrangement, in performing printing work on the sheet, the printing can be made while giving transferring force to the sheet, thereby stabilizing the printing. In addition, in empty-feeding the sheet, the platen roller can give the transferring force to the sheet being fed, thereby smoothly introducing the sheet to the sheet ejecting slot.

It is preferable that the sheet transfer device, the platen roller and the ribbon feed device have a common driving source and a common power transmission gear train, wherein the power transmission gear train comprises: a main sun gear which is rotated by the driving source; a first planet gear which is engaged with the main sun gear; a first intermediate gear with which the first planet gear comes into or out of engagement; a second planet gear which is engaged with the first intermediate gear serving as a sun gear; a second intermediate gear with which the second planet gear comes into or out of engagement; wherein the sheet transfer device has a transfer-drive roller which transfers the sheet and which receives an input of power from the first planet gear, wherein the platen roller receives an input of power from the second planet gear, wherein the ribbon feed device has a ribbon take-up shaft which takes up the ink ribbon and which receives an input of power from the second intermediate gear, wherein the back-and-forth moving device has a planet carrier which supports the second planet gear and which causes the second planet gear to come into engagement or out of engagement with the second intermediate gear, and wherein the ribbon feed suspension device is the second planet gear which causes the power to the second intermediate gear to be shut off as a result a movement, by the planet carrier, of the second planet gear out of engagement with the second intermediate gear.

According to this arrangement, the power to the ribbon feed device is shut off as a result of the fact that the second planet gear is brought, by means of the planet carrier, out of engagement with the second intermediate gear. In other words, it is possible to make the back-and-forth moving device and the ribbon-feed suspension device simpler in structure. In addition, by increasing the common part which shares the functions for a plurality of devices, the structure can be simplified.

It is preferable that the system further comprise: a sheet bundle printer which performs printing on an uppermost sheet peeled out of the bundle of sheet; and a computer which is connected to the sheet bundle printer and which controls the same, wherein the sheet bundle printer has the sheet transfer device, the printing device, the ribbon feed device, the back-and-forth moving device, the ribbon-feed suspension device, and the detecting device, and wherein the computer has the control device.

According to this arrangement, by controlling the sheet printer with the computer, the feeding of the ink ribbon can be suspended at the time of empty-feeding of the sheet.

A sheet bundle printer according to another aspect of the invention has all the devices of the above-described sheet bundle printing system.

According to this arrangement, the sheet bundle printer as singly used can suspend the ink-ribbon feeding at the time of empty feeding of the sheet.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, a description will be made about a sheet bundle printing system relating to an embodiment of the invention as a sticky note printing system. The sticky note printing system operates in the following manner. In other words, based on printing data edited by a personal computer, the sticky note printer turns over or flips an uppermost piece of sticky note (hereinafter simply referred to as "a sticky note") out of a sticky note bundle (a sheet bundle). The flipped sticky note is subjected to printing while being peeled off. The printed sticky note is then ejected out of the printer.

Figure 1:
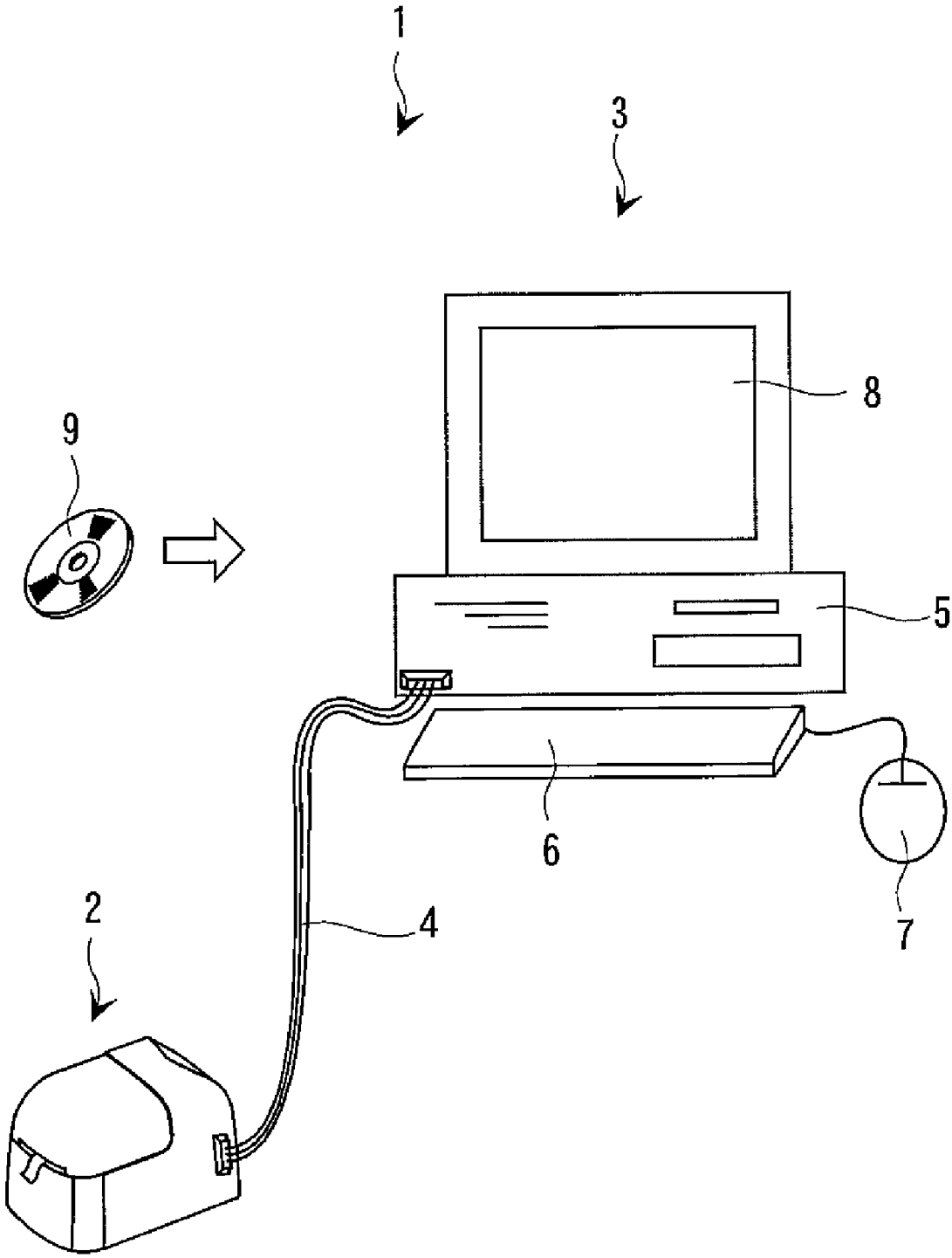
FIG. 1 is a schematic diagram showing a sticky note printing system according to an embodiment of the invention.

As shown in FIG. 1, the sticky note printing system 1 is made up of: a sticky note printer 2 which has set in position a sticky note bundle H (see FIG. 3); and a personal computer 3 (control device) which is connected to the sticky note printer 2 through a USB 4 and the like for generating and editing printing data to be printed on the sticky note H1 and controlling the various drives of the sticky note printer 2.

The personal computer 3 is made up of: a personal computer main body 5; a keyboard 6 and a mouse 7 connected to the personal computer main body 5 and used for inputting data; and a display 8 for displaying the result of inputting and the like. The personal computer main body 5 has removably set therein a CD-ROM 9 which has stored therein data of application software (program), device driver and the like about the sticky note printer 2. When various detected signals, various commands, various data and the like are inputted from the keyboard 6 and the like, the personal computer 3 processes various data according to the program stored in the CD-ROM 9, thereby controlling the sticky note printer 2.

The sticky note printer 2 may be provided with a function of preparing and editing printing data as well as a control function for each part so that the sticky note printer 2 can be used as a stand-alone, thereby effecting printing on a sticky note H1.

Figure 2:
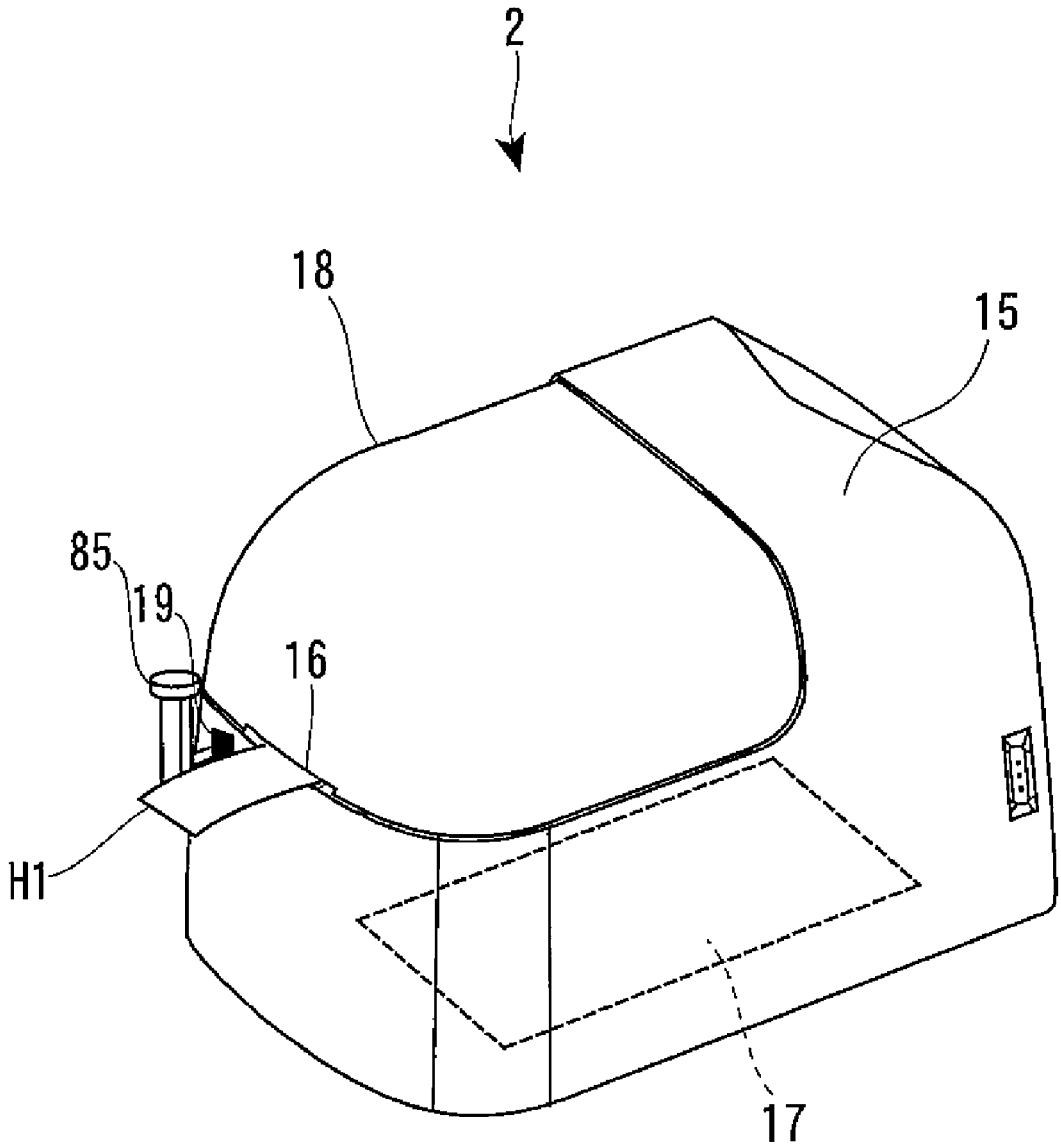
FIG. 2 is an outside perspective view of a sticky note printer according to the embodiment of the invention.

As shown in FIG. 2, the sticky note printer 2 has an outer shell constituted by an apparatus case 15. The apparatus case 15 is arranged so that a sticky note bundle H can be set in position inside the apparatus case 15. The sticky note printer 2 performs printing of desired characters, prepared by the personal computer 3, on the sticky note H1 that has been peeled off out of the sticky note bundle H set in position. The printed sticky note is then ejected out of the sheet ejecting slot 16 formed in the apparatus case 15.

The apparatus case 15 is formed small in size as a whole and has formed therein a sticky note introducing opening 17 for setting in position the sticky note bundle H inside the apparatus case 15. In a front central portion of the apparatus case 15, there is formed an ejecting slot 16 in the shape of a horizontal slit for ejecting the printed sticky note H1 out of the apparatus case. On the upper surface of the apparatus case 15, there is provided an open-close lid 18 for receiving a ribbon cartridge C containing an ink ribbon R and for performing maintenance inside the sticky note printer. Moreover, on the left front side of the apparatus case 15, there is provided an operation opening 19 which a manual operation lever 85 (described hereinafter) faces so as to allow the up-and-down movement of the manual operation lever 85.

Figure 3:
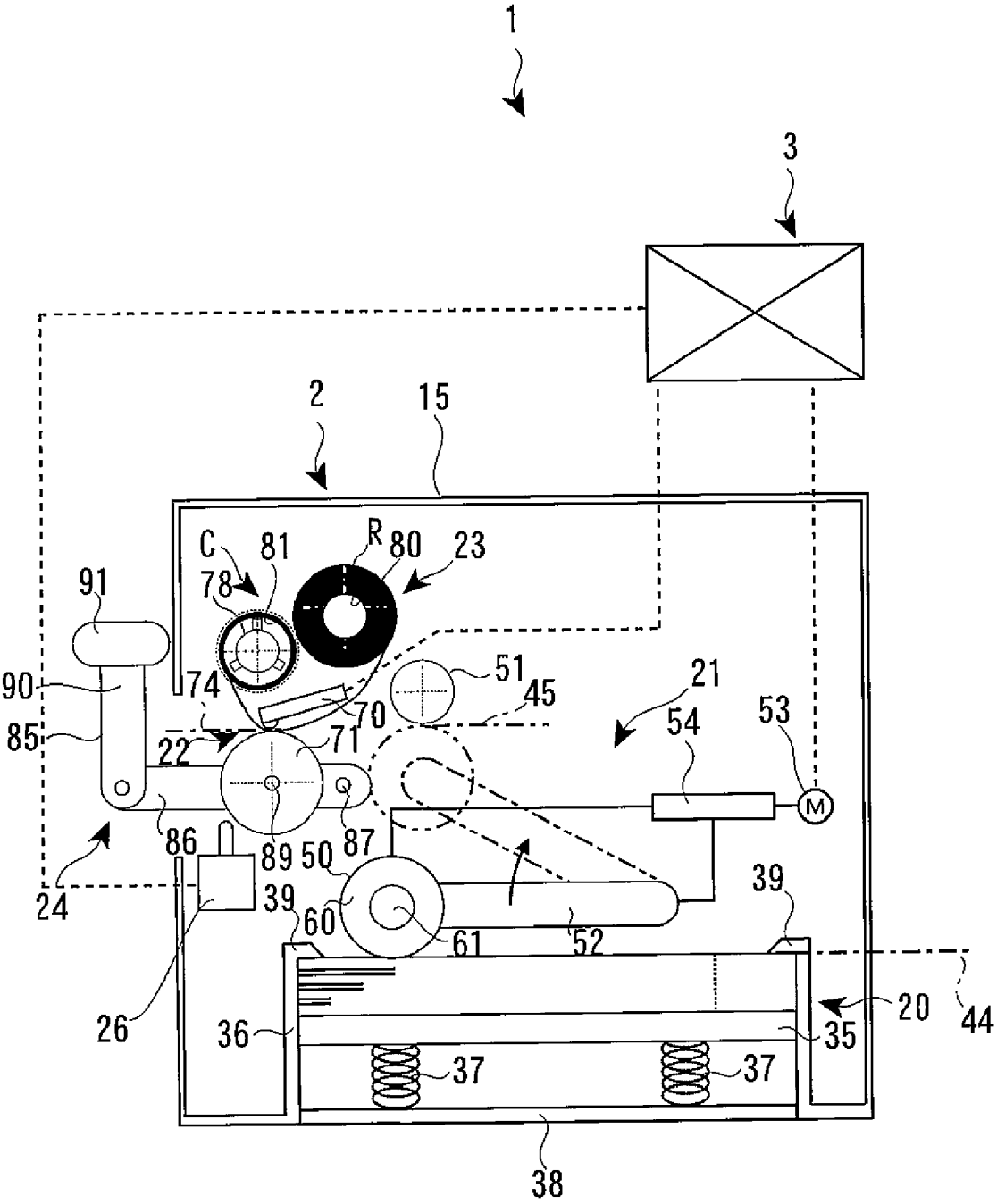
FIG. 3 is a schematic diagram of an inside arrangement of the sticky note printer according to the embodiment of the invention.

As shown in FIG. 3, the sticky note bundle H is constituted by a plurality of sticky notes H1 which are respectively partly and removably glued at a rear base portion thereof. In other words, the sticky note bundle H is made up by laminating a plurality of sticky notes H1 of the same shape (rectangular) and the same size by partly gluing the base portion on the rear surface respectively. The sticky note bundle H is arranged to be capable of being peeled off one by one from the sticky note bundle H. It is also so arranged that the sticky note can be adhered again on an object of adhesion (i.e., an object to which the sticky note is adhered) such as a notebook and the like by means of the glued portion (adhesive agent) at the base portion.

The sticky note printer 2 is made up of: a sticky note holder 20 which sets in position the sticky note bundle H; a sticky note transfer device (sheet transfer device) 21 which, after having flipped the uppermost sticky note H1 from the sticky note bundle H that has been set in position and subsequently peeled it off, transfers it toward the sheet ejecting slot 16; a printing device 22 which performs printing, by means of a thermal head (printing head) 70 and a platen roller 71, on the sticky note H1 to be transferred by the sticky note transfer device 21; a ribbon feed device 23 which feeds an ink ribbon R to be used for printing; a back-and-forth moving device 24 which moves the platen roller 71 to the thermal head 70 by a manual operation lever 85 back and forth (i.e., between a position in which the platen roller 71 is in contact with the printing head 70 and a contact-free position in which the platen roller 71 is out of contact with the thermal head 70 (As noted earlier, the term "back-and-forth" generically denotes the capability of movement between predetermined two positions. The direction of movement shall therefore be interpreted not limiting to "back" and "forth"; it is intended to denote a "first" position and a "second" position)). The sticky note printer 2 also has a ribbon feed suspension device 25 which suspends (or stops) the feeding of the ink ribbon R in a manner interlocked with the operation of the back-and-forth moving device 24. The above-described devices are housed inside the apparatus case 15. The sticky note printer 2 is further provided with: a detection sensor (detecting device) 26 which detects the fact that the platen roller 71 has been brought out of contact with the thermal head 70; and a lock-and-unlock mechanism 27 which maintains the platen roller 71 in the state in which the platen roller 71 is out of contact with the thermal head 70 by means of the back-and-forth moving device 24 and which also releases this maintained state.

The sticky note holder 20 is made up of: a mounting stage 35 on which the sticky note bundle H is horizontally mounted, and which is arranged to hold the sticky note bundle H of a given size and is formed into a box shape with an upper surface left open; an introducing guide 36 of an enclosed frame shape, which slidably guides the mounting stage 35 up and down; and a lid 38 which supports the mounting stage 35 from the bottom side through a plurality of coil springs 37 and which closes the sticky note introducing opening 17. On upper front and rear end portions of the introducing guide 36, there are provided, in an inwardly projecting manner, a pair of front and rear position-restricting portions 39 which hold the free end (i.e., the end not glued together) and the fixed end (i.e., the portion in the end which is partially glued together) of the sticky note bundle H. The mounting stage 35 is urged upward by means of the plurality of coiled springs 37. As a result, even if the sticky notes are fed out one by one and decreased in number, the sticky note bundle H set in position in the mounting stage 35 is arranged to keep the level of the uppermost sticky note H1 to a predetermined height by means of the pair of position-restricting portions 39. The position at which the sticky note bundle H is set becomes a pickup position 44 at which the uppermost sticky note H1 is flipped by the sticky note transfer device 21.

The sticky note holder 20 is detachably mounted inside of the apparatus case 15 such that the lid 38 is latched in a snap-in style relative to the apparatus case 15. In other words, in order to set the sticky note bundle H in position into the sticky note holder 20, the sticky note holder 20 is taken out of the apparatus case 15. After having set in position the sticky note bundle H into the mounting stage 35, the sticky note holder 20 is mounted into the apparatus case 15.

The sticky note transfer device 21 is arranged to flip the uppermost sticky note H1 of the sticky note bundle H lying in the pickup position 44, and is made up of: a feed roller 50 which comes into rotating contact with the uppermost sticky note H1 to thereby flip it and also peels the flipped sticky note off from the sticky note bundle H; a driven roller 51 which holds the flipped sticky note H1 between the driven roller 51 and the feed roller 50; a pair of rotary arms 52 which move (or swing) the feed roller 50 between a pickup position 44 in which the sticky note H1 is flipped and a holding position (sandwiching position) 45 in which the sticky note H1 is held (or sandwiched) between the driven roller 51 and the feed roller 50; a drive motor 53 which serves as the driving source (power source) for the feed roller 50 and the pair of rotary arms 52; and a reduction gear train (power transmission gear train) 54 which transmits the driving power of the drive motor 53 to the feed roller 50 and the pair of rotary arms 52

The feed roller 50 comes into rotating contact with the rear surface on the free end of the flipped sticky note H1 and, at the holding position 45, feeds the sticky note by rotation while peeling it off from the sticky note bundle H. The feed roller 50 is made up of: a roller main body 60 which comes into direct rotating contact with the sticky note H1; and a roller drive shaft 61 which serves as a rotary shaft of the roller main body 60. The roller drive shaft 61 is rotatably (or swingably) supported at both end portions by means of a pair of rotary (or swing) arms 52 so as to rotate by the power to be transmitted through the reduction gear train 54 (details will be described hereinafter).

The pair of rotary arms 52 rotatably hold the roller drive shaft 61 at their front end portions and are also constituted to be rotatable (or swingable) about their base end portions. On a side surface of one of the pair of rotary arms 52, there is provided a release projection 65 (see FIG. 5) which comes into contact with a contact piece 116 (to be described hereinafter). By means of this release projection 65, the lock-and-unlock mechanism 27 is released from locking (details will be described hereinafter). The rotary arms 52 move between the pickup position 44 and the holding position 45 by that power of the drive motor 53 which is transmitted through the reduction gear train 54.

The printing device 22 is made up of: a thermal head 70 which is disposed near the sheet ejecting slot 16 and which is formed to have a width substantially the same as that of the feed roller 50; and a platen roller 71 which is disposed so as to face the thermal head 70. The platen roller 71 is provided so as to extend in the width direction of the sticky note H1 and is arranged to be coupled to the reduction gear train 54 when the feed roller 50 moves to the holding position 45, thereby rotating by the inputting of the power from the drive motor 53. The platen roller 71 thus performs printing by the thermal head 70 while giving a transferring force to the fed sticky note H1. The printing on the sticky note H1 can thus be performed in a stable manner. Moreover, the platen roller 71 is moved by the back-and-forth moving device 24 (to be described in detail hereinafter) between a printing position 74 (i.e., one of the "back" position and the "forth" position) in which the platen roller 71 is urged against the thermal head 70 and a contact-free position 75 (i.e., the other of the back position and the forth position) in which the platen roller 71 is out of contact with the thermal head 70. The printing device 22 thus constituted performs printing on the sticky note H1 while the thermal head 70 and the drive motor 53 are controlled by the control signal from the personal computer 3.

The ribbon feed device 23 is made up of: a ribbon cartridge C; and a ribbon take-up shaft 78 which takes up the ink ribbon R of the mounted ribbon cartridge C. The ribbon take-up shaft 78 is arranged to be coupled to the reduction gear train 54 when the feed roller 50 moves to the holding position 45 and when the platen roller 71 moves to the printing position 74, thereby rotating by the inputting of the power from the drive motor 53. The ribbon cartridge C is made up of: a ribbon supply reel 80 having wound thereabout the ink ribbon R in a manner to be freely supplied; a ribbon take-up reel 81 which takes up the ink ribbon R; and a cartridge case (not shown) which houses the above reels in a rotatable manner.

When the open/close lid 18 is opened and the ribbon cartridge C is mounted in the apparatus case 15, the ink ribbon R is sandwiched between the thermal head 70 and the platen roller 71, and the ribbon take-up reel 81 is rotatably mounted on the ribbon take-up shaft 78. When drive for printing by the printing device 22 is started, the ribbon take-up shaft 78 runs parallel with the feeding of the sticky note H1, thereby starting the take-up (feeding) of the ink ribbon R.

The back-and-forth moving device 24 is formed into a figure "L" by: a manual operation lever 85 which operates to move the platen roller 71 between the printing position 74 and the contact-free position 75; and a supporting member 86 which supports the platen roller 71, communicating with the manual operation lever 85. The base end portion of the supporting member 86 is rotatably supported by the rotary shaft 87 fixed to the apparatus case 15. In other words, the claimed back-and-forth link is constituted by the supporting member 86 and the rotary shaft 87.

In a print standby state, the supporting member 86 is lifted by a return spring 88 (see FIG. 5) so that the platen roller 71 approaches the printing position 74. On the side surface of the supporting member 86 there is provided a platen support shaft 89 for rotatably supporting the platen roller 71, in a manner to project in the widthwise direction of the sticky note H1. The manual operation lever 85 is made up of: a lever main body 90 which is provided so as to extend upward from a front end portion of the supporting member 86; and an operation button 91 which is provided on the upper surface of the lever main body 90. When the operation button 91 is depressed by the user, the supporting member 86 rotates downward about the rotary shaft 87 against the return spring 88, and the platen roller 71 moves from the printing position 74 to the contact-free position 75.

Figure 4A:
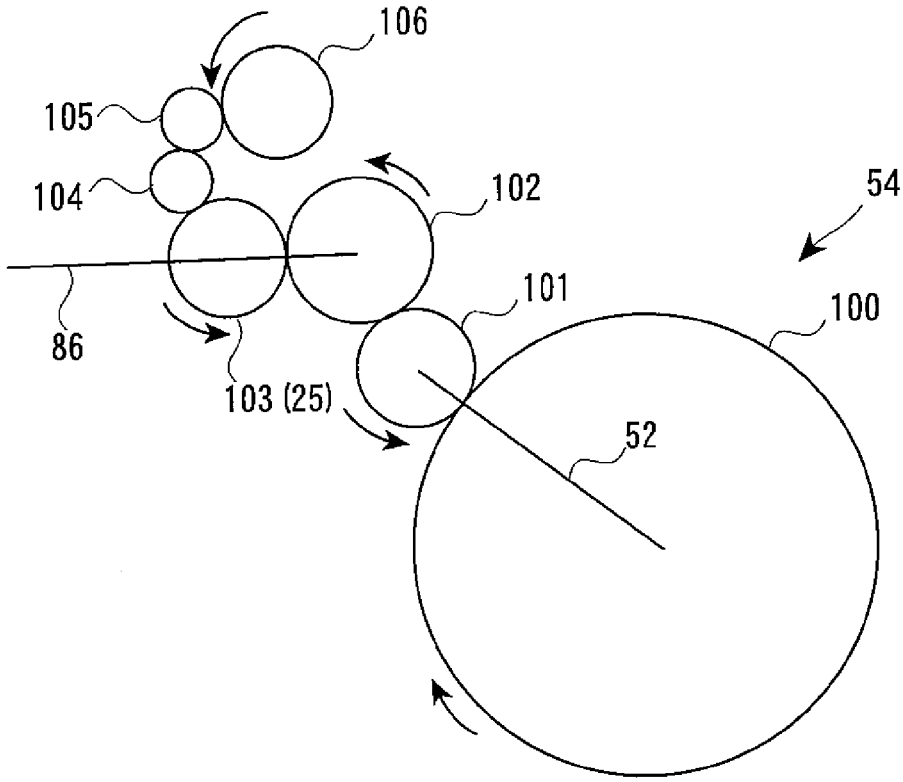
FIGS. 4A and 4B are schematic diagrams of reduction gear trains.
Figure 4B:
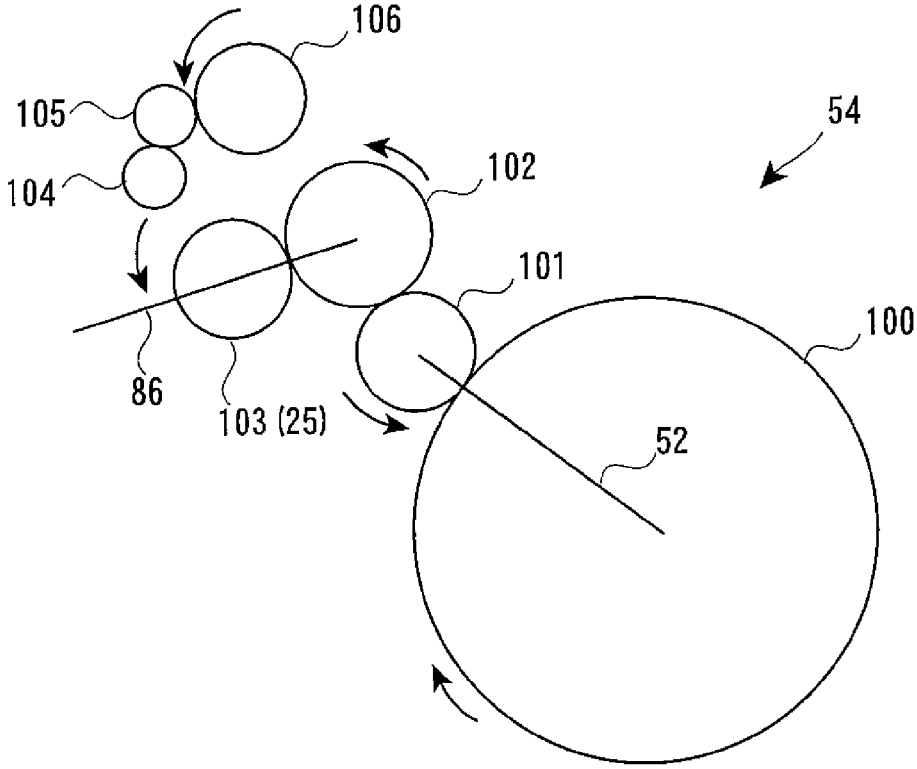

With reference to FIGS. 4A and 4B, a description will now be made in detail about the reduction gear train 54. The reduction gear train 54 is to transmit the power of the drive motor 53 to: the feed roller 50 and the pair of rotary arms 52 of the sticky note transfer device 21; the platen roller 71 of the printing device 22; as well as to the ribbon take-up shaft 78 of the ribbon feed device 23. The reduction gear train 54 has a construction of having built in planet gears as required and is made up of: a main sun gear 100 which is rotated by the power of the drive motor 53 and is formed to have the largest diameter; a first planet gear 101 which is engaged (or meshed) with the main sun gear 100; a first intermediate gear 102 with which the first planet gear 101 comes into or out of engagement; a second planet gear 103 which is engaged with the first intermediate gear 102 serving as a sun gear; a second intermediate gear 104 with which the second planet gear 103 comes into or out of engagement; a third intermediate gear 105 with which the second planet gear 103 comes into or out of engagement; and a fourth intermediate gear 106 which is engaged with the third intermediate gear 105.

The main sun gear 100 is disposed such that the shaft thereof is coaxial with the shaft on the base end of the pair of rotary arms 52. The first planet gear 101 outputs the power to the feed roller 50 which is disposed coaxially therewith. One of the pair of rotary arms 52 serves as a planet carrier of the first planet gear 101 which is coaxial with the main sun gear 100. In other words, the position in which the first planet gear 101 engages with the first intermediate gear 102 is the holding position 45 in which the feed roller 50 comes into contact with the driven roller 51. The position in which the first planet gear 101 is away from (out of engagement with) the first intermediate gear 102 so that the rotary arms 52 are horizontally arranged, is defined as the pickup position 44. Therefore, it is so arranged that, as a result of rotary movement of the pair of rotary arms 52 between the pickup position 44 and the holding position 45, the feed roller 50 is designed to move while rotating. The rotary movement of the pair of rotary arms 52 is performed by an end cam (not shown) which moves by the above-described drive motor 53 as the power source.

The first intermediate gear 102 is disposed such that the shaft thereof is coaxial with the rotary axis 87 which rotatably supports the supporting member 86. The second planet gear 103 outputs the power to the coaxially disposed platen roller 71. Part of the supporting member 86 serves as the planet carrier of the secondary planet gear 103 which is coaxial with the first intermediate gear 102. In other words, the position in which the second planet gear 103 engages with the second intermediate gear 104 is the printing position 74 in which the platen roller 71 comes into contact with the thermal head 70. The position in which the second planet gear 103 is away from the second intermediate gear 104 is the contact-free position 75. Therefore, the platen roller 71 rotates in a state in which it faces the printing position 74 and the contact-free position 75.

The power transmitted to the second intermediate gear 104 is transmitted to the fourth intermediate gear 106 through the third intermediate gear 105. The fourth intermediate gear 106 outputs the power to the coaxially disposed ribbon take-up shaft 78. The ribbon take-up shaft 78 indirectly receives the power input from the second intermediate gear 104. Since the fourth intermediate gear 106 is for adjusting the direction of rotation, the ribbon take-up shaft 78 may be so constructed, instead of the above-described example, that the power is directly inputted from the second intermediate gear 104, i.e., coaxially mounted on the second intermediate gear 104.

When the drive motor 53 rotates in a state in which the platen roller 71 faces the printing position 74, the feed roller 50 facing the pick-up position 44 is caused to lie in the holding position 45 while rotating. Once the feed roller 50 approaches the holding position 45, the first planet gear 101 is coupled to the first intermediate gear 102, thereby transmitting the power of the drive motor 53 to the platen roller 71 and, also, the power is transmitted to the ribbon take-up shaft 78 through the second and third intermediate gears 104 and 105. On the other hand, in a state in which the platen roller approaches the contact-free position 75, the second planet gear 103 is out of engagement with the second intermediate gear 104, whereby the power to the ribbon take-up shaft 78 is shut off. Therefore, when the platen roller 71 is away from the printing position 74, the taking up of the ink ribbon R by the ribbon feed device 23 is stopped. In other words, the claimed ribbon-feed suspension device 25 corresponds to the second planet gear 103. According to this arrangement, there can be obtained the following advantages. Namely, the drive motor 53 can be commonly used and, since the commonly served parts increase in number, the construction (or structure) can be simplified. As a consequence, the construction of the back-and-forth moving device 24 and the ribbon-feed suspension device 25 can also be simplified in construction.

Figure 5:
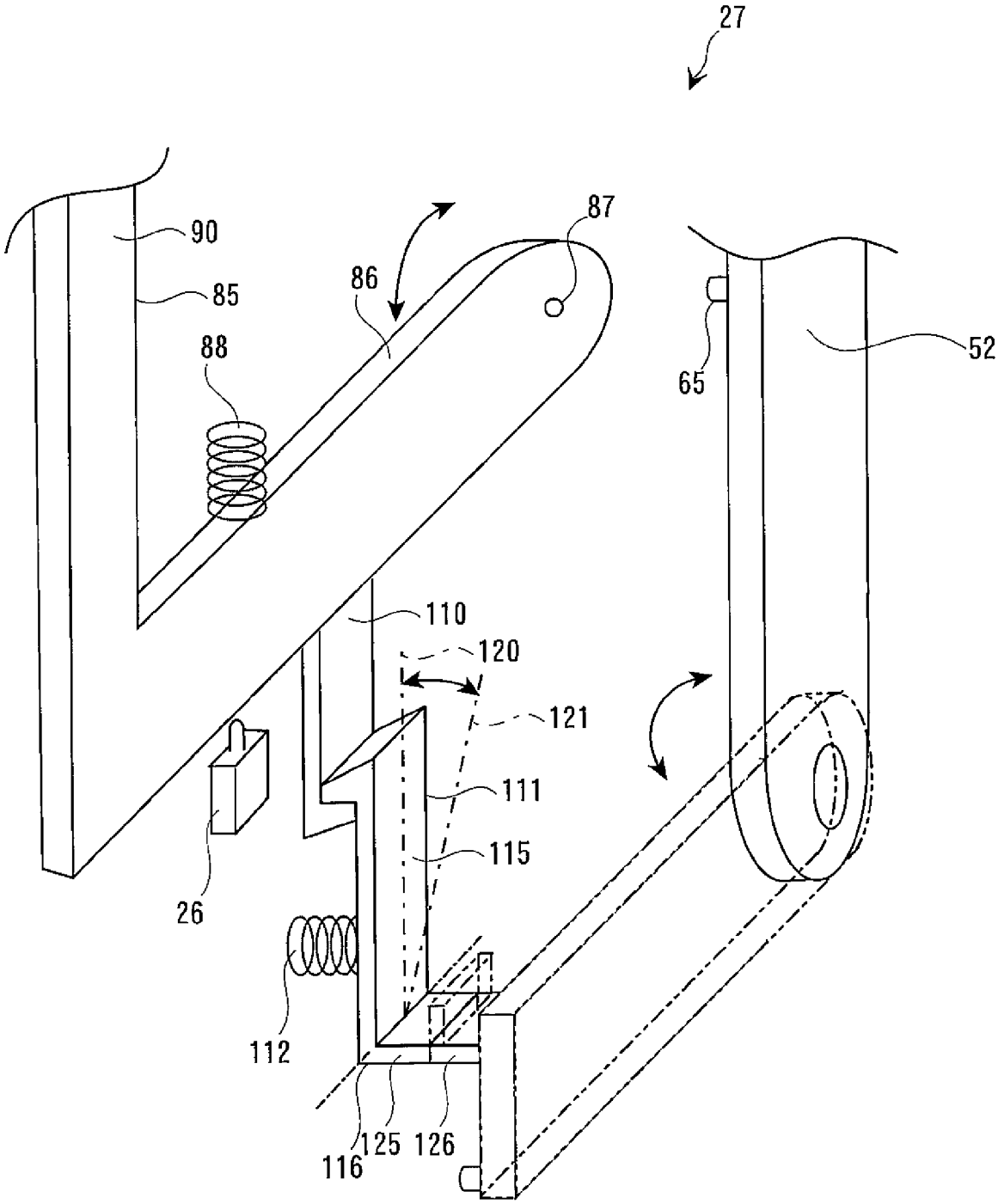
FIG. 5 is a schematic perspective view showing a lock-and-unlock mechanism.

As shown in FIG. 5, the lock-and-unlock mechanism 27 is made up of: a first engaging claw 110 which is formed to project downward from the bottom surface of the supporting member 86; a second engaging claw 111 which is formed into a figure "L" by an engaging portion 115 to be engaged with the first engaging claw 110 and a contact piece 116 to be engaged with one of the pair of rotary arms 52; a pull spring 112 which pulls the second engaging claw 111 toward the supporting member 86; and a release projection 65 which is disposed on the side surface of one of the pair of rotary arms 52.

The first engaging claw 110 moves up and down to follow the rotary movement of the supporting member 86. When the platen roller 71 is in the printing position, the first engaging claw 110 is located at an upper position, thereby being in a state of out of engagement with the second engaging claw 111. When the platen roller 71 is in the contact-free position 75, the first engaging claw 110 is located at a lower position, thereby being in engagement with the second engaging claw 111, i.e., attaining a locked state.

The second engaging claw 111 is rotatably supported at the bent portion and moves between the locked position 120 in which the second engaging claw 111 is engaged with the first engaging claw 110, and the unlocked position in which the engagement with the first engaging claw 110 is released. The engaging portion 115 is arranged to be engaged with the first engaging claw 110, whereby the engaging portion 115 is pulled so that the engaging portion 115 approaches the locked position 120. The contact piece 116 is made up of: a stationary piece 125 which is in communication with the engaging portion 115; and a movable piece 126 which is disposed at a front end of the stationary piece 125. The movable piece 126 is provided so as to come into contact with the release projection 65 by the motion of the rotary arms 52. When the release projection 65 is moved from the holding position 45 to the pickup position 44, the movable piece 126 moves integrally with the stationary piece 125 so as to move the engaging portion 115 to a lock release position 121. On the other hand, when the release projection 65 is moved from the pickup position 44 to the holding position 45, only the movable piece 126 is moved to allow for the movement of the release projection 65 so as to maintain the state of causing the engaging portion 115 to approach the locked position 120.

When the manual operation lever 85 is pulled down or depressed by the user, the first engaging claw 110 moves downward and also once pushes down the second engaging claw 111 approaching the locked position 120, thereby engaging therewith into the locked state. When the rotary arms 52 thereafter moves from the pickup position 44 to the holding position 45, the contact piece 116 allows the release projection 65 to move, thereby maintaining the locked state of the second engaging claw 111. When the rotary arms 52 return from the holding position 45 to the pickup position 44, the release projection 65 comes into contact with the contact piece 116, thereby pulling down the second engaging claw 111 to the lock release position 121. Then, the first engaging claw 110 is pulled up by means of the return spring 88 through the supporting member 86, and the platen roller 71 moves to the printing position 74.

According to this arrangement, by operating the manual operation lever 85, the platen roller 71 is locked at the contact-free position by means of the lock-and-unlock mechanism 27. Therefore, there is no need for the user to keep on operating the manual operation lever 85 during the transfer of the sticky note H1. On the other hand, when the sticky note transfer device 21 has finished transferring, the locking is released as a result of this finishing. Consequently, the platen roller 71 moves to the printing position 74 and, therefore, it is not necessary for the user to return the platen roller 71 by operating the manual operation lever 85. The manual operation lever 85 thus has an ease with which it is operated.

The detection sensor 26 is provided under the supporting member 86 and is constituted by a micro switch. In this arrangement, when the supporting member 86 is moved downward through the manual operation lever 85 so that the platen roller 71 approaches the contact-free position 75, the lower surface of the supporting member 86 comes into contact with the front end of the detection sensor 26. The platen roller 71 is thus detected to have been moved to the contact-free position 75. In addition, when the detection sensor 26 has detected the movement of the platen roller 71 to the contact-free position 75, the personal computer 3 drives only the sticky note transfer device 21 without driving the printing device 22. As a result, the sticky note H1 that has been peeled off by the sticky note transfer device 22 is transferred without performing printing thereon. It follows that the empty feeding of the sticky note H1 will not be performed in a state in which the thermal head 70 and the platen roller 71 are in contact with each other due to a mechanical trouble. The detection sensor 26 is not limited to the micro switch, but may be of an optical sensor such as a photo-interrupter and the like.

With reference to FIGS. 6A to 6G, a description will now be made about a series of empty-feeding operations of the sticky note H1. In the print standby state, the feed roller 50 is in the pickup position 44 and is in rotating contact with the surface of the uppermost sticky note H1 among the sticky note bundle H set in position in the sticky note holder 20 (see FIG. 6A).

When the user pushes down the manual operation lever 85, and the personal computer 3 recognizes the fact that the detection sensor 26 has detected the movement of the platen roller 71 to the contact-free position 75, the personal computer 3 causes the feed roller 50 to rotate, thereby starting to flip the sticky note H1. In other words, as a result of rotating contact of the feed roller 50 with the free end on the top surface of the uppermost sticky note H1, the intermediate portion of the flipped sticky note as seen in the longitudinal direction thereof is gradually deformed or bent upward. In addition, in a manner interlocked with pushing down of the manual operation lever 85, the power to the ribbon take-up shaft 78 is shut off and, also, the manual operation lever 85 is locked by the lock-and-unlock mechanism 27 (see FIG. 6B).

When, right after the front end of the sticky note H1 under flipping movement has passed under the feed roller 50, the feed roller 50 moves upward, while rotating, away from the sticky note bundle H, the sticky note H1 is flipped up toward the upper side of the feed roller 50 by the rotary force of the feed roller 50. The free end portion of the sticky note H1 lies on top of the feed roller 50 (see FIG. 6C).

Figures 6A, 6B, 6C, 6D, 6E, 6F, 6G:
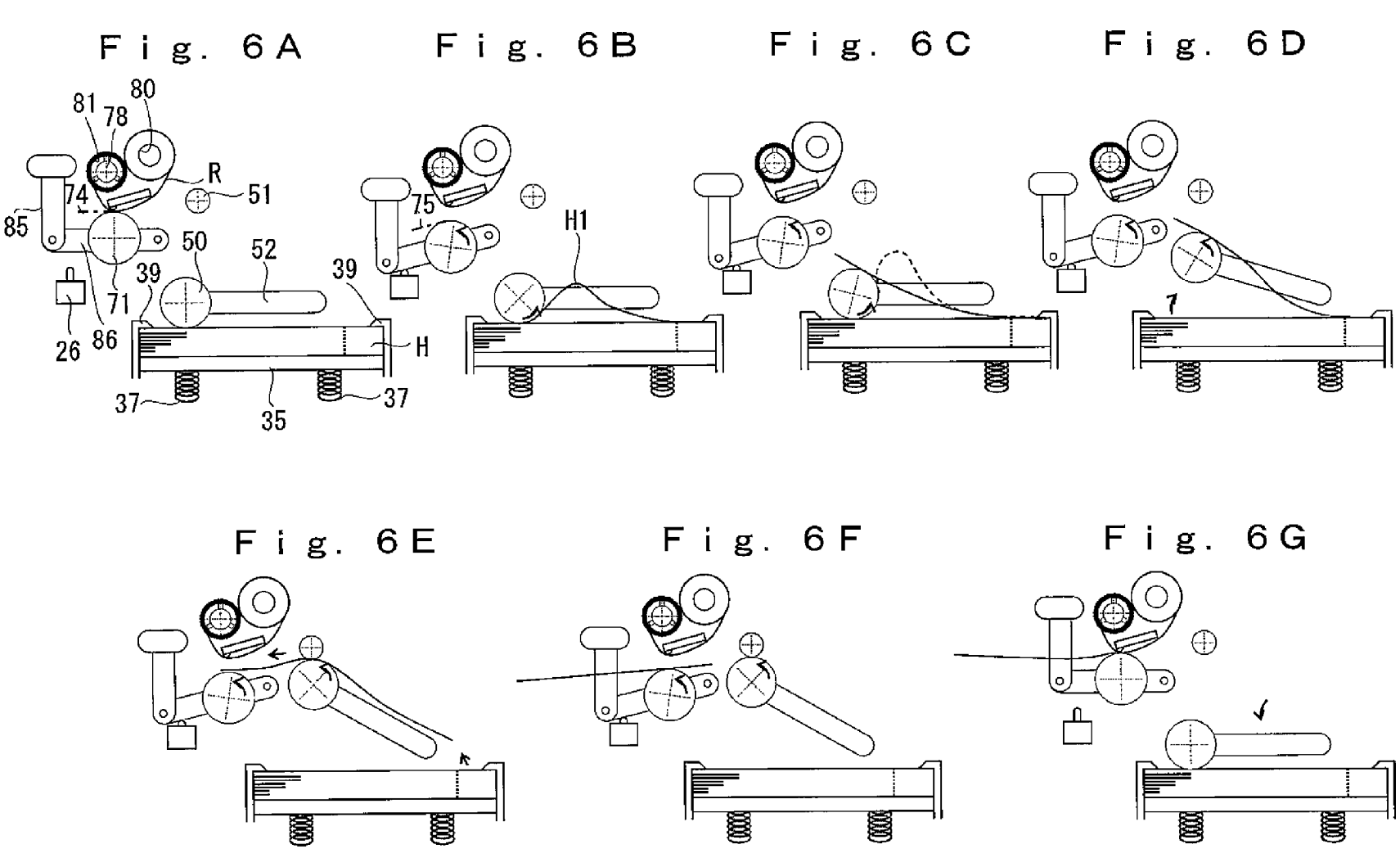
FIGS. 6A to 6G are a series of explanation diagrams relating to the empty feeding of a sticky note.

The feed roller 50 having the sticky note H1 thereon then moves (i.e., revolves about the center of rotation of the rotary arms 52), while rotating (on its own axis), to the holding position 45 (see FIG. 6D). When the feed roller 50 reaches the holding position 45 to thereby hold the sticky note H1 between the feed roller 50 and the driven roller 51, the feed roller 50 peels the flipped sticky note H1 off from the sticky note bundle H. The peeled-off sticky note H1 is transferred by the feed roller 50 and the platen roller 71 toward the sheet ejecting slot 16 (see FIG. 6E).

When the glued portion of the sticky note H1 has reached the platen roller 71 (see FIG. 6F), the feed roller 50 moves from the holding position 45 to the pickup position 44. Then, the rotary arms 52 release the locking of the lock-and-unlock mechanism 27. As a result, the platen roller 71 approaches the printing position 74 to thereby hold the glued portion of the sticky note H1 (see FIG. 6G). Thereafter, the user may remove the sticky note H1 that has been ejected to the sheet ejecting slot 16. In this manner, the user can obtain the sticky note H1 that was empty-fed (i.e., fed without performing printing thereon).

According to the above arrangement, the feeding of the ink ribbon R can be stopped by moving the platen roller 71 to the contact-free position 75. Therefore, when the sticky note H1 is transferred by the sticky note transfer device 21, the ink ribbon R will not be fed and, thus, it is possible to feed a brand-new sticky note H1. In addition, since the thermal head 70 and the platen roller 71 are kept apart from each other, the sticky note H1 and the ink ribbon R will not be held together (or sandwiched). As a result, there is no possibility of causing the ink ribbon R to be fed together with the sticky note H1. It is thus possible to empty-feed the sticky note H1 without feeding the ink ribbon R. Although a sticky note bundle H is used in this embodiment, there may alternatively be used a memo pad or the like whose one fixed end portion is glued together. In addition, although the platen roller 71 is arranged to be moved, there may alternatively be used an arrangement in which the thermal head 70 is moved. In case the ribbon feed device 23 is driven by another driving source, there may be employed an arrangement in which the power of the ink-ribbon feeding is stopped based on detection with the detection sensor 26.

Figure 7:
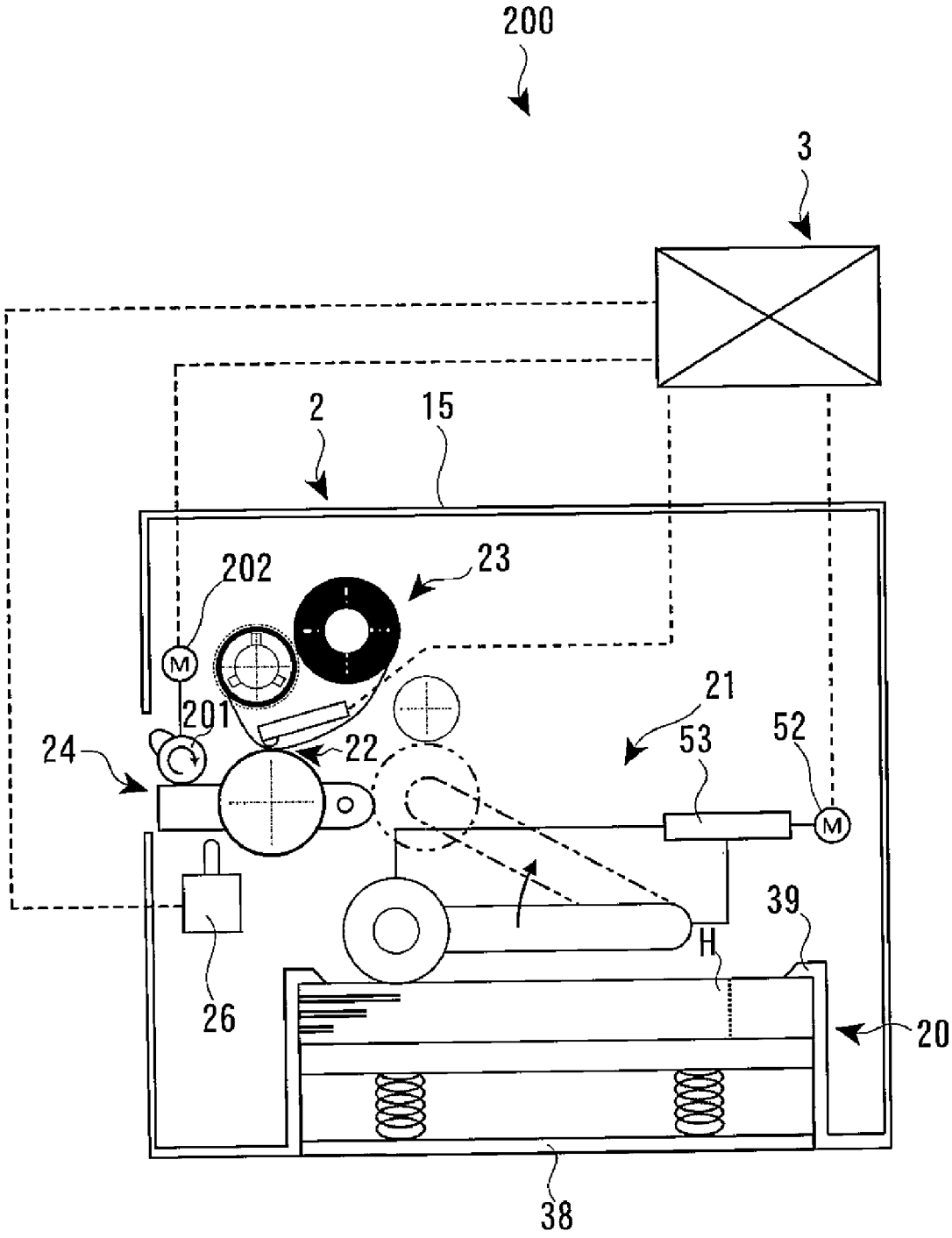
FIG. 7 is a schematic diagram of an inside arrangement of the sticky note printer according to a second embodiment of the invention.

With reference to FIG. 7, a description will now be made about a sticky note printing system 200 according to a second embodiment of the invention. In order to avoid duplicated description, only the portions which are different from those in the above-described first embodiment are described. The sticky note printing system 200 is made up, instead of the manual operation lever 85 of the sticky note printer 2 in the first embodiment, of: a plate cam 201 which presses downward an upper end surface of the supporting member 86; and a motor 202 which rotates the plate cam. A motor 202 is controlled by the personal computer 3.

When the motor 202 is driven by the personal computer 3 in order to empty-feed the sticky note H1, the plate cam 201 rotates, and the projected portion thereof pushes downward an upper end surface of the supporting member 86 to thereby cause the platen roller 71 to approach the contact-free position 75. The power to the ribbon feed device 23 is thereby shut off and the driving of the motor 202 is stopped in this state. Then, when the empty feeding of the sticky note H1 is finished, the motor 202 is driven again to thereby move upward the projected portion of the plate cam 201. The platen roller 71 is thus returned to the printing position 74 by means of the return spring 88. In this arrangement, too, the sticky note H1 can be empty-fed without feeding the ink ribbon R.

Figure 8:
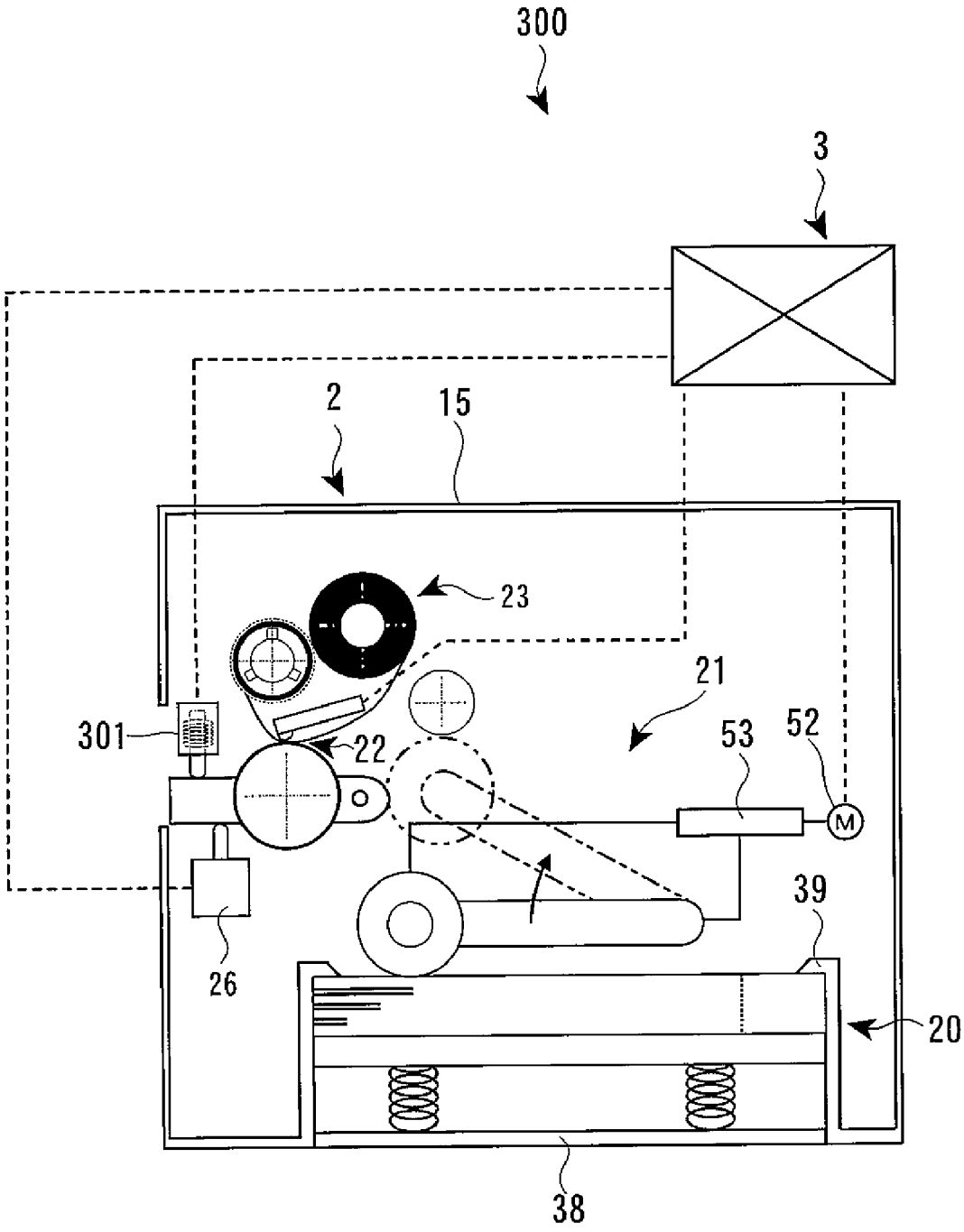
FIG. 8 is a schematic diagram of an inside arrangement of the sticky note printer according to a third embodiment of the invention.

With reference to FIG. 8, a description will now be made about a sticky note printing system 300 according to a third embodiment of the invention. In order to avoid duplicated description, only the portions which are different from each other are described. The sticky note printing system 300 is made up, instead of the manual operation lever 85 of the sticky note printer 2 in the first embodiment, of: a solenoid 301 which pushes downward an upper end surface of the supporting member 86. The solenoid 301 is controlled by the personal computer 3.

When the solenoid 301 is excited by the personal computer 3 in order to empty-feed the sticky note H1, a plunger pushes downward the upper end surface of the supporting member 86. The platen roller 71 is thus caused to approach the contact-free position 75, and the power to the ribbon feed device 23 is shut off. When the empty-feeding of the sticky note H1 has been finished, the solenoid 301 is degaussed and the platen roller 71 is returned to the printing position 74 by the return spring 88. In this arrangement, too, the sticky note H1 can be empty-fed without feeding the ink ribbon R.

What is claimed is:

1. A sheet bundle printing system comprising:

a sheet transfer device for transferring a sheet toward a sheet ejecting slot by peeling an uppermost sheet out of a sheet bundle made up of a multiplicity of sheets releasably adhered together at one end respectively;

a printing device having a printing head and a platen roller, the printing device being for printing on a sheet fed by the sheet transfer device through space between the printing head and the platen roller;

a ribbon feed device for feeding an ink ribbon through space between the printing head and the platen roller, the feeding being made in parallel with the sheet at the time of printing thereon;

a back-and-forth moving device for manually moving the platen roller relative to the printing head between a printing position in which the platen roller is urged into contact with the printing head and a contact-free position in which the platen roller is out of contact with the printing head; and a ribbon-feed suspension device for suspending the ink-ribbon feeding by the ribbon feed device in a manner interlocked with a relative movement, by the back-and-forth moving device, of the printing head and the platen roller between the printing position and the contact-free position, wherein the back-and-forth moving device comprises: a manual operation lever for moving the platen roller back and forth; and a back-and-forth moving link for moving the platen roller back and forth in a manner interlocked with operation of the manual operation lever.

2. The system according to claim 1, further comprising a lock-and-unlock mechanism which maintains the platen roller in the contact-free position in a manner interlocked with the operation of the manual operation lever and which, in a manner interlocked with termination of transfer movement by the transfer device, releases the state of maintaining the platen roller at the contact-free position, thereby moving the platen roller to the printing position.

3. The system according to claim 1, wherein the platen roller is made up of a driving roller and drives in a manner synchronized with the driving of the sheet transfer device.

4. A sheet bundle printing system comprising:

a sheet transfer device for transferring a sheet toward a sheet electing slot by peeling an uppermost sheet out of a sheet bundle made up of a multiplicity of sheets releasably adhered together at, one end respectively;

a printing device having a printing head and a platen roller, the printing device being for printing on a sheet fed by the sheet transfer device through space between the printing head and the platen roller;

a ribbon feed device for feeding an ink ribbon through space between the printing head and the platen roller, the feeding being made in parallel with the sheet at the time of printing thereon;

a back-and-forth moving device for moving the platen roller relative to the printing head between a printing position in which the platen roller is urged into contact with the printing head and a contact-free position in which the platen roller is out of contact with the printing head; and a ribbon-feed suspension device for suspending the ink-ribbon feeding by the ribbon feed device in a manner interlocked with a relative movement, by the back-and-forth moving device, of the printing head and the platen roller between the printing position and the contact-free position, wherein the platen roller is made up of a driving roller and drives in a manner synchronized with the driving of the sheet transfer device, the sheet transfer device, the platen roller and the ribbon feed device have a common driving source and a common power transmission gear train, the power transmission gear train comprises: a main sun gear which is rotated by the driving source; a first planet gear which is engaged with the main sun gear; a first intermediate gear with which the first planet gear comes into or out of engagement; a second planet gear which is engaged with the first intermediate gear serving as a sun gear; and a second intermediate gear with which the second planet gear comes into or out of engagement, the sheet transfer device has a transfer-drive roller which transfers the sheet and which receives an input of power from the first planet gear, the platen roller receives an input of power from the second planet gear, the ribbon feed device has a ribbon take-up shaft which takes up the ink ribbon and which receives an input of power from the second intermediate gear, the back-and-forth moving device has a planet carrier which supports the second planet gear and which causes the second planet gear to come into engagement or out of engagement with the second intermediate gear, and the ribbon feed suspension device is the second planet gear which causes the power to the second intermediate gear to be shut off as a result a movement, by the planet carrier, of the second planet gear out of engagement with the second intermediate gear.

5. The system according to claim 4, wherein the back-and-forth moving device comprises: a solenoid for moving the platen roller back and forth; and a back-and-forth moving link for moving the platen roller back and forth in a manner interlocked with driving of the solenoid.

6. The system according to claim 4, wherein the back-and-forth moving device comprises: an actuator for moving the platen roller back and forth; a plate cam rotated by driving of the actuator; and a back-and-forth moving link for moving the platen roller into the contact-free position by bringing the plate cam into contact therewith.

7. A sheet bundle printing system comprising:

a sheet transfer device for transferring a sheet toward a sheet electing slot by peeling an uppermost sheet out of a sheet bundle made up of a multiplicity of sheets releasably adhered together at one end respectively;

a printing device having a printing head and a platen roller, the printing device being for printing on a sheet fed by the sheet transfer device through space between the printing head and the platen roller;

a ribbon feed device for feeding an ink ribbon through space between the printing head and the platen roller, the feeding being made in parallel with the sheet at the time of printing thereon;

a back-and-forth moving device for manually moving the platen roller relative to the printing head between a printing position in which the platen roller is urged into contact with the printing head and a contact-free position in which the platen roller is out of contact with the printing head;

a ribbon-feed suspension device for suspending the ink-ribbon feeding by the ribbon feed device in a manner interlocked with a relative movement, by the back-and-forth moving device, of the printing head and the platen roller between the printing position and the contact-free position;

a detecting device for detecting that the platen roller has moved to the contact-free position relative to the printing head; and a control device for controlling the sheet transfer device and the printing device, wherein the control device feeds the sheet to the sheet ejecting slot without printing thereon depending on the result of detection by the detecting device.

8. A sheet bundle printing system comprising:

a sheet transfer device for transferring a sheet toward a sheet ejecting slot by peeling an uppermost sheet out of a sheet bundle made up of a multiplicity of sheets releasably adhered together at one end respectively;

a printing device having a printing head and a platen roller, the printing device being for printing on a sheet fed by the sheet transfer device through space between the printing head and the platen roller;

a ribbon feed device for feeding an ink ribbon through space between the printing head and the platen roller, the feeding being made in parallel with the sheet at the time of printing thereon;

a back-and-forth moving device for manually moving the platen roller relative to the printing head between a printing position in which the platen roller is urged into contact with the printing head and a contact-free position in which the platen roller is out of contact with the printing head;

a ribbon-feed suspension device for suspending the ink-ribbon feeding by the ribbon feed device in a manner interlocked with a relative movement, by the back-and-forth moving device, of the printing head and the platen roller between the printing position and the contact-free position, wherein the platen roller is made up of a driving roller and drives in a manner synchronized with the driving of the sheet transfer device, the sheet transfer device, the platen roller and the ribbon feed device have a common driving source and a common power transmission gear train, the power transmission gear train comprises: a main sun gear which is rotated by the driving source; a first planet gear which is engaged with the main sun gear; a first intermediate gear with which the first planet gear comes into or out of engagement; a second planet gear which is engaged with the first intermediate gear serving as a sun gear; and a second intermediate gear with which the second planet gear comes into or out of engagement;

the sheet transfer device has a transfer-drive roller which transfers the sheet and which receives an input of power from the first planet gear, the platen roller receives an input of power from the second planet gear, the ribbon feed device has a ribbon take-up shaft which takes up the ink ribbon and which receives an input of power from the second intermediate gear, the back-and-forth moving device has a planet carrier which supports the second planet gear and which causes the second planet gear to come into engagement or out of engagement with the second intermediate gear, and the ribbon feed suspension device is the second planet gear which causes the power to the second intermediate gear to be shut off as a result a movement, by the planet carrier, of the second planet gear out of engagement with the second intermediate gear.

* * * * *